US006217187B1

(12) United States Patent
Demsko

(10) Patent No.: US 6,217,187 B1
(45) Date of Patent: Apr. 17, 2001

(54) BATON FOR DISPLAYING AND STORING LIGHT STICKS

(76) Inventor: J. Vincent Demsko, 8065 Round Moon Cir., Jessup, MD (US) 20794

( * ) Notice: Subject to any disclaimer, the term of this patent is extended or adjusted under 35 U.S.C. 154(b) by 0 days.

(21) Appl. No.: 09/428,448

(22) Filed: Oct. 28, 1999

(51) Int. Cl.[7] ..... F21K 2/06
(52) U.S. Cl. ..... 362/84; 362/102
(58) Field of Search ..... 362/84, 102, 171

(56) References Cited

U.S. PATENT DOCUMENTS

| | | | | |
|---|---|---|---|---|
| D. 331,889 | | 12/1992 | Kaplan . | |
| D. 356,276 | | 3/1995 | Liu et al. . | |
| D. 368,045 | | 3/1996 | Akers, Sr. . | |
| D. 370,276 | | 5/1996 | Davis . | |
| 3,576,987 | | 5/1971 | Voight et al. . | |
| 4,064,428 | | 12/1977 | Van Zandt . | |
| 4,508,642 | | 4/1985 | World . | |
| 4,812,952 | * | 3/1989 | Clemens | 362/84 |
| 5,280,743 | * | 1/1994 | Abel et al. | 362/102 X |
| 5,307,251 | * | 4/1994 | Shaffer | 362/84 X |
| 6,065,847 | * | 5/2000 | Palmer et al. | 362/84 X |
| 6,070,987 | * | 6/2000 | Jarvik | 362/84 |

* cited by examiner

*Primary Examiner*—Laura K. Tso
(74) *Attorney, Agent, or Firm*—George C. Atwell

(57) ABSTRACT

A hand-carriable baton for displaying at least one chemiluminescent light stick which provides a determinate period of ambient light includes an elongated tubular body having first and second ends, and an inner bore coequal in length with the body. The bore is closed at the first end by a removably securable cap to which a lanyard is attached, and secured to the second end is a socket member. One illumination producer in the form of a chemiluminescent light stick is mounted to the socket member for projecting outwardly therefrom for providing ambient light of fixed duration while a second illumination producer, also a chemiluminescent light stick, is stored within the bore for replacing the first light stick. The tubular body also includes an anti-rotation element adjacent the second end to prevent the device from rolling away from the user if dropped on any ground surface.

8 Claims, 1 Drawing Sheet

BATON FOR DISPLAYING AND STORING LIGHT STICKS

FIELD OF THE INVENTION

The present invention relates to a holder for providing ambient light, and, more particularly, relates to a hand-held or portable baton for displaying and storing light sticks.

Among the common devices which provide light for an area or surface are candles, lamps, flashlights, streetlights, lanterns, and flares. Such lights have general purpose as well as recreational and safety uses. When flashlights, lanterns, and flares (which can be hand-held or mounted on sawhorses, stands, and barriers) are used in safety, hazard, and emergency situations, their purposes are varied, such as illuminating a dangerous area, like a collapsed structure, a washed out road or bridge, or a traffic accident scene. Flashlights, lanterns, and flares are also commonly used to assist in traffic and crowd control at public gatherings and events, such as fairs; air, boat, and car shows; and sporting competitions of all kinds.

One disadvantage of flares, in particular, is that they drip a noxious chemical substance during their use. When used by public safety and emergency personnel, such as police officers, firefighters, and EMT's, the flares are mounted on the road or road berm or held or waved by the public safety personnel for signaling to pedestrians and drivers that they are approaching a dangerous situation and should exercise caution in proceeding therethrough. However, if hand-held, the flares will drip and splatter the noxious substance on the uniform of the personnel, which will soil the uniforms and cause unsightly and/or unsafe holes to be produced thereon. New uniforms must then be purchased which are quite often an out-of-pocket expense for the personnel.

DESCRIPTION OF THE PRIOR ART

While flashlights, lamps, lanterns, and flares have been, and continue to be, used in various emergency and public safety situations, they have a number of shortcomings, especially when they must be held, carried, or manually waved by public safety personnel for extended periods of time. Waving lamps, lanterns, and policemen's flashlights over an extended period of time produces muscle strain and fatigue for the user. In addition, these devices produce only white light and, depending upon the circumstances, white light may not be the most penetrating or visible. Moreover, in many emergency and danger situations, a beam of white light may not be the most desirable form of light for warning approaching pedestrians or vehicles of the dangerous condition. An example of a light displaying device is the lighted baton of U.S. Pat. No. Des. 370,276.

SUMMARY OF THE INVENTION

The present invention comprehends a device for providing ambient light, and, more particularly, comprehends a hand-held or ground-mounted baton for displaying a first visible light source and storing therein a second light source.

The baton includes an elongated, generally tubular-shaped body having a first end and an opposite second end. The body also includes an inner bore which defines a storage chamber or compartment and is coequal in length with the body and extends from the first end to the second end. The first end of the body is closed by a removably securable cap or plug and mounted to the second end is a socket member. At least one illumination producer, generator or source in the form of a chemically-activated light stick is contained within the storage compartment, and a second light stick is mounted to the socket member so that a major portion of that light stick projects outwardly from the socket member for generating ambient illumination. A preferred light stick is described in U.S. Pat. No. 4,508,642, and is incorporated herein by reference. The light sticks shown in U.S. Pat. Nos. Des. 331,889, Des. 356,276, and Des. 368,045 can also be used with the baton of the present invention. In addition, U.S. Pat. Nos. 3,576,987 and 4,064,428 disclose light sticks composed of a range of compounds for producing chemiluminescent light, and both of these light sticks can be used with the baton of the present invention.

It is an objective of the present invention to provide a baton which is portable and easy to store and transport.

It is another objective of the present invention to provide a baton which includes an auxiliary or secondary illumination source as a replacement for the primary illumination source.

Still another objective of the present invention is to provide a baton which is lighter than a policeman's flashlight and safety flare and thereby produces less muscle fatigue and strain from the policeman's continuous waving of the baton during emergency or public safety situations.

Yet another objective of the present invention is to provide a baton which can be hand-held or carried pendent from the neck.

A further objective of the present invention is to provide a baton having an illumination source which produces various colors of light in addition to the standard white light of a flashlight.

A still further objective of the present invention is to provide a baton having as its illumination source at least one chemiluminescent light stick whereby attaching the light stick to the baton allows the light stick to throw more light than if the light stick is hand-held because a substantial portion of the light stick body projects outwardly from the baton.

Yet a further objective of the present invention is to provide a baton that includes structure to raise the light emitting end off the ground when the baton is set on the ground.

These and other features, objects, and advantages of the present invention will become apparent with reference to the follow description and accompanying drawings.

DETAILED DESCRIPTION OF THE PREFERRED EMBODIMENT

Figure 2:
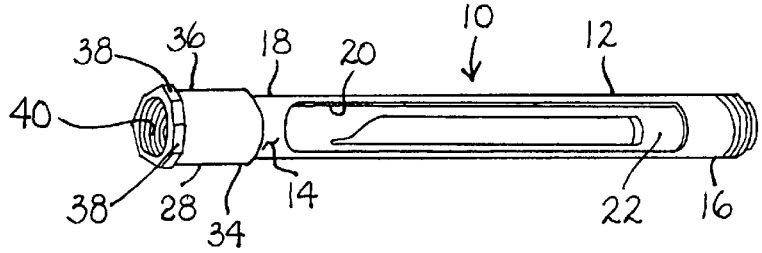
FIG. 2 is a perspective view of the baton with the body of the baton broken away.
Figure 1:
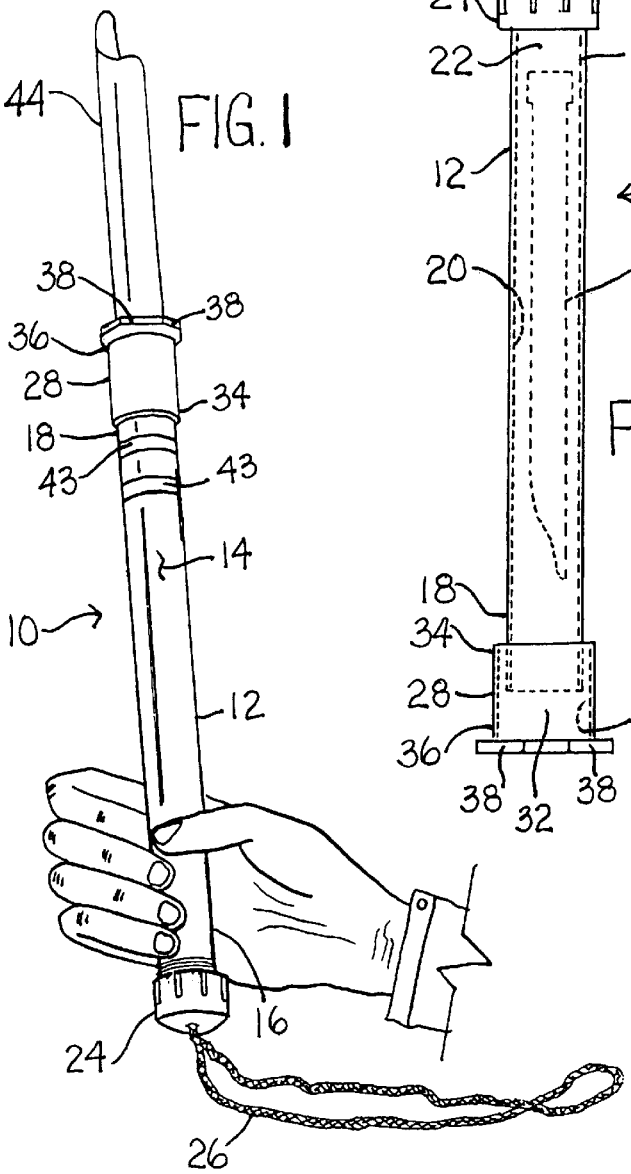
FIG. 1 is a perspective view of the baton being held by an individual in the use disposition.
Figure 3:
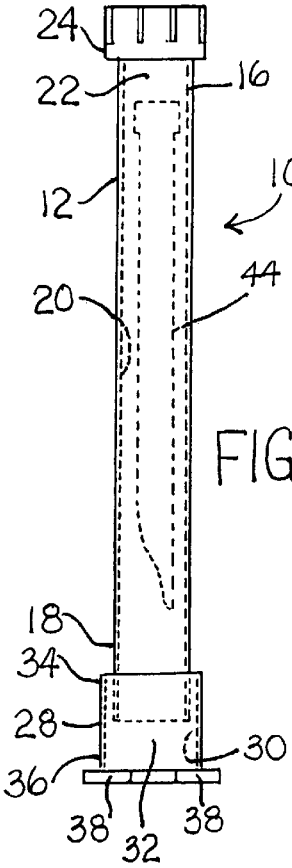
FIG. 3 is an elevational view of the baton first shown in FIG. 1.

As shown in FIGS. 1–5, the baton 10 includes an elongated, generally tubular-shaped body 12 which has a diameter which permits the user to easily grip and hold the baton 10. The body 12 defines a generally cylindrical, exterior surface or sidewall 14 and is preferably constructed from a lightweight and durable plastic, such as polyvinylchloride (PVC), so that the body 12 is usable in all weather conditions. As shown in FIGS. 1–3, the body 12 is cylindrically-shaped, but, in the alternative, the body 12 could be square or rectangular-shaped. The body 12 includes a first end 16, an opposite second end 18, and an interior sidewall 20 which is coequal in length with the body 12. The annular, interior sidewall 20 further defines an internal passageway or bore 22 which is coextensive with the sidewall 20. Furthermore, the bore 22 defines an internal storage chamber, receptacle, or compartment, the purpose of which will be more fully described hereinafter. The first end 16 can be threaded to receive a closure means, such as a removably securable cap 24. The attachment of the cap 24 to the first end 16 closes or seals the bore 22 at the first end 16. A plug could also be used in place of the cap 24. In addition, the cap 24 includes a lanyard 26 which allows the user to wear the baton 10 pendent from the user's neck so that the user's hands are free for other tasks.

Illustrated in FIGS. 1–3 and 5 is an illumination mounting means which can be integrally and permanently formed to the second end 18 of the body 12 or can be adapted for removable securement to the second end by being snapped or threaded thereon. The illumination mounting means of the present invention is a generally cylindrical-shaped socket member 28 which is mounted to the second end 18 of the body 12 so that the socket member 28 is in axial alignment with the bore 22 and the body 12. The socket member 28 includes an interior, annular sidewall 30 which is circumjacent a socket passageway or bore 32, and, when the socket member 28 is mounted to the second end 18 of the body 12, both bores 22 and 32 are disposed in axial alignment with each other. The socket member 28 also includes an inner end 34 and an opposite outer end 36. It is possible for the bore 32 of socket member 28 to terminate as a blind hole adjacent the inner end 34.

As illustrated in FIGS. 1–3 and 5, the socket member 28 also includes an anti-rotation means to restrict and limit the ability of the baton 10 to roll away from the user and under vehicles or off of the road surface should the baton 10 be accidentally dropped by the user. The anti-rotation means for the baton 10 includes a plurality of upraised flat surfaces or flats 38 integrally formed on the exterior cylindrical surface of the socket member 28 and which project radially and laterally therefrom adjacent the outer end 36 of the socket member 28. The flats 38 are also circumjacent the bore 32 of the socket member 28. The lateral and radial extension of the flats 38 from the exterior surface of the socket member can be increased from that shown in FIGS. 1–3 and 5 whereby the second end 18 of the baton 10 will be raised up from the ground a distance determined by the lateral extension of the flats 38. The baton 10 adjacent the first end 16 will remain on the ground, and the distance the second end 18 is raised above the ground will depend, in part, on the magnitude of the lateral extension of the flats 38 from the socket member 28. The structure of the flats 38 both provides an anti-rotation means for the baton 10 as well as enhancing the display of light when the baton 10 is set upon the ground.

Figure 5:
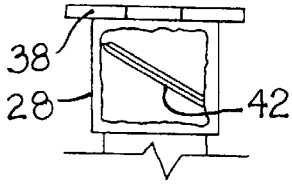
FIG. 5 is a sectioned elevational view of the baton first shown in FIG. 1.
Figure 4:
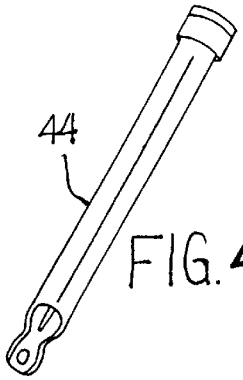
FIG. 4 is a perspective view of a light stick first shown in FIG. 1.

As shown in FIGS. 2, 3, and 5, in order to support or hold the illumination producer or generator to or within the socket member 28, the socket member 28 can include a plurality of internal threads 40 disposed circumjacent the bore 32. In addition, as shown in FIG. 5, the socket member 28 can also include, in the alternative, a singular annular tooth or projection 42 projecting inwardly from the sidewall 30. The projection 42 of FIG. 5 is helical in form but could be an annular horizontal projection instead. An alternative embodiment of the flats 38 could have them extend the length of the socket member 28 from the outer end 36 to the inner end 34. Also, to enhance the visibility of the baton 10, one or more bands or stripes 43 of fluorescent material can be painted or taped onto the body 12 of the tube 10 as shown in FIG. 1.

As illustrated in FIGS. 1–5, the illumination producer, generator, or source is at least one, and, as used with the baton 10 of the present invention, two commercially available chemiluminescent light sticks 44 that can be purchased from safety products suppliers and distributors, retail hardware stores, and hunting, camping, and outdoor equipment suppliers. One version of a light stick is described in U.S. Pat. No. 4,508,642 and is incorporated in this specification by reference. Light sticks vary in the duration within which they produce light, and two common time durations are the one-half hour duration of high intensity ambient light production and the twelve hour time duration of ambient light production. The light produced is generally of the three primary colors: red, green, and blue. The baton 10 can contain and display light sticks 44 described in U.S. Pat. No. 4,508,642, as well as other light sticks currently available on the market. In order to initiate illumination, the user gently and slightly bends the light stick 44, which action causes an internal chamber, tube, or casing to rupture, thereby causing the chemicals contained therein to admix with the chemicals contained within an outer casing or tube whereupon ambient light is produced and is viewable through the outer casing or tube. The light stick then returns to its normal longitudinal orientation. The light stick 44 includes a base end which generally has a diameter slightly larger than the diameter of the body of the light stick 44. The light stick 44 also includes an opposite tapered or hook end which allows the light stick 44 to be tied to and dangled from a belt or pack when used by military personnel. Because the external casing or body of the light stick 44 is of a non-rigid, waxy, plastic composition, such as polyethylene, polypropylene, or TEFLON, the light sticks are never directly inserted or mounted into the ground, but are most commonly held or waved by, for example, a police officer or fireman.

When the baton 10 is used by a police officer, fireman, or an EMT in a public safety and emergency situation, the cap 24 is temporarily removed so that one light stick 44 can be fully inserted within the bore 22 of the body 12 whereupon the bore 22 serves as the storage chamber or receptacle for containing that respective light stick 44. The cap 24 is then reattached to the first end 16 for closing off the storage chamber at the first end 16 in order to prevent that light stick 44 from falling out. The second light stick 44 is then mounted to the socket member 28 and, for the present invention, the base of the second light stick 44 can simply be rotated several turns against the threads 40, whereupon the surface of the base is scored by the threads 40—or by the singular annular projection 42—and is thereby secured to the socket member 28 at the outer end 36. The surface hardness of the threads 40 or annular projection 42 must be greater than the surface hardness of the exterior sidewall 14 of the body of the light stick 44 so that the threads 40 or annular projections 42 can be easily dig into and grip the base as the light stick 44 is being rotated into the bore 32 of the socket member 28. It is also possible for the base end of the light stick 44 to be press-fitted into the bore 32 for attaching the light stick 44 to the socket member 28. A substantial portion of that light stick 44 will protrude outwardly from the socket member 28, and that light stick 44 will be in axial alignment with the bore 32 as well as the bore 22 of the baton 10. The light stick 44 mounted to the socket member 28 may be referred to as the in-use light stick, and the light stick 44 contained and stored within the storage compartment or receptacle defined by bore 22 may be referred to as the replacement light stick. Because a substantial portion of the body of the in-use light stick 44 will project out from the socket member 28, this light stick 44 will throw out much more light than a normally hand-held light stick 44 wherein perhaps one-half of the body of the hand-held light stick 44, and, thus, much of its light, will be obscured by the user's hand. Should the user desire to lay the baton 10 on the ground while the in-use light stick 44 is projecting from the socket member 28 and radiating light, the laterally-projecting flats 38 serve to raise the baton 10 off the ground at an angle determined by the magnitude of the lateral projection of the flats 38 from the external sidewall of the socket member 28. This allows the light emanating from the light stick 34 to have more visibility at a greater distance.

Therefore, when the illumination producing chemicals of the in-use light stick 44 are exhausted, that light stick 44 can be removed from the bore 32 of the socket member 28 for proper disposal. The user can then remove the cap 24 from the first end 16 of the body 12 and withdraw the replacement light stick 44 from the bore 22 so that the replacement light stick 44 can be mounted to the socket member 28 and thereupon slightly bent to initiate the chemical reaction which causes the replacement light stick to produce ambient light for the user. In addition, the body 12 could be lengthened so that the bore 22 could store two or more light sticks 44 in series, or the body 12 could be widened so that two or more light sticks 44 could be placed side-by-side for storage therein. For proper fitting therein, the light sticks 44 may need to be flip-flopped so that the tapered end of one light stick 44 would be next to the base of an adjacent light stick 44.

A number of different types of bases or stands could be used with the baton 10 in order to avoid physically inserting the baton 10 into the ground. The first end 16 of the body 12 would be inserted within or secured to such a base or stand, thereby freeing the user to move about the area unencumbered by holding or waving the baton 10.

Although the invention has been herein shown and described in what is believed to be the most practical preferred embodiment, it is recognized that departures may be made therefrom while still keeping within the scope of the invention.

What is claimed is:

1. A hand-carriable baton for storing and holding chemiluminescent light sticks, the baton comprising:

an elongated tubular body having a first end, an opposite second end, and an internal bore extending from the first end to the second end and coextensive therewith and the bore defining an interior storage compartment;

closure means for removable securement to the first end of the body;

a socket member mounted to the second end of the body and coaxial with the body; and the socket member having an external sidewall and an internal, annular sidewall which defines a passageway for receiving and holding at least one light stick, at least one annular projection extending from the sidewall circumjacent the passageway and to which the end of the light stick is secured, and a plurality of continuous upraised flats extending laterally from the external sidewall.

2. The baton of claim 1 wherein the closure means is a cap threadably secured to the first end of the body.

3. For use in combination with chemiluminescent light sticks, a hand-carriable baton, comprising:

an elongated tubular body, a first end, an opposite second end, and an internal bore coequal in length with the tubular body and extending from the first end to the second end;

closure means for removable securement to the first end of the body;

a socket member mounted to the second end coaxial with the internal bore of the body; and a plurality of chemiluminescent light sticks for providing ambient illumination, with a first light stick mounted to project from the socket member coaxial therewith so that a substantial portion of the first light stick extends outwardly from the body and at least a second light stick identical to the first light stick stored within the bore for selective removal therefrom to replace the first light stick.

4. A hand-carriable baton for providing ambient light, comprising:

an elongated tubular body having a first end, an opposite second end, and an internal bore extending from the first end to the second end and coextensive with the tubular body;

closure means for closing the first end of the body;

a socket member attached to the second end of the body and coaxial with the bore of the body, the socket member having an external sidewall and an inner annular sidewall defining a socket bore;

a first light stick secured to the socket member and coaxial with the socket member so that a substantial portion of the first light stick projects from the socket bore for providing ambient light; and a second light stick contained within the bore of the body and capable of removal therefrom for securement to the socket member in order to replace the first light stick.

5. The baton of claim 4 further comprising an anti-rotation means formed on the external sidewall of the socket member circumjacent the socket bore for preventing the baton from rolling when dropped on a ground surface.

6. The baton of claim 5 wherein the anti-rotation means includes a plurality of upraised flats projecting laterally from the external sidewall circumjacent the socket bore.

7. The baton of claim 6 wherein the socket member includes at least one annular projection extending along the inner sidewall and to which one end of one light stick is secured.

8. The baton of claim 7 wherein the surface hardness of the annular projection is greater than the surface hardness of the light sticks so that the light sticks can be secured to the annular projection by being rotated thereagainst and then selectively removed therefrom.

* * * * *